US007332136B2

(12) United States Patent
Heed

(10) Patent No.: US 7,332,136 B2
(45) Date of Patent: Feb. 19, 2008

(54) AIRBOX IN A REGENERATIVE THERMAL OXIDISER

(75) Inventor: Bjorn Heed, Gothenburg (SE)

(73) Assignee: Megtec Systems AB, Gothenburg (SE)

( * ) Notice: Subject to any disclaimer, the term of this patent is extended or adjusted under 35 U.S.C. 154(b) by 647 days.

(21) Appl. No.: 10/203,348

(22) PCT Filed: Jan. 19, 2001

(86) PCT No.: PCT/SE01/00092

§ 371 (c)(1),
(2), (4) Date: Oct. 10, 2002

(87) PCT Pub. No.: WO01/59367

PCT Pub. Date: Aug. 16, 2001

(65) Prior Publication Data

US 2003/0143139 A1 Jul. 31, 2003

(30) Foreign Application Priority Data

Feb. 11, 2000 (SE) ..... 0000424

(51) Int. Cl.
*F01N 3/08* (2006.01)

(52) U.S. Cl. ..... 422/179; 422/220; 422/176

(58) Field of Classification Search ..... 422/173, 422/175–177, 178, 182; 432/181–182; 110/211; 431/170

See application file for complete search history.

(56) References Cited

U.S. PATENT DOCUMENTS

| | | | | | |
|---|---|---|---|---|---|
| 3,702,595 | A | * | 11/1972 | Muirhead et al. | 110/245 |
| 4,650,414 | A | * | 3/1987 | Grenfell | 422/175 |
| 4,741,690 | A | | 5/1988 | Heed | 431/7 |
| 5,024,817 | A | | 6/1991 | Mattison | 422/175 |
| 5,134,945 | A | | 8/1992 | Reimlinger et al. | |
| 5,484,575 | A | * | 1/1996 | Steenackers | 422/176 |
| 5,562,442 | A | * | 10/1996 | Wilhelm | 432/72 |
| 5,770,165 | A | * | 6/1998 | Truppi et al. | 422/175 |
| 5,967,771 | A | | 10/1999 | Chen et al. | |

FOREIGN PATENT DOCUMENTS

| | | |
|---|---|---|
| SE | 463 940 B | 2/1991 |
| WO | 93/12382 A | 6/1993 |

* cited by examiner

*Primary Examiner*—Glenn Caldarola
*Assistant Examiner*—Tom Duong
(74) *Attorney, Agent, or Firm*—Birch, Stewart, Kolasch & Birch, LLP

(57) ABSTRACT

An air box in a regenerative thermal oxidiser has one or several beds of a heat-storing and heat-transferring material. The air box is connected with a gas inlet/outlet and comprises a gas permeable surface that is turned towards one of the beds. The air box has distribution devices provided in the air box.

22 Claims, 2 Drawing Sheets

AIRBOX IN A REGENERATIVE THERMAL OXIDISER

This application is the national phase under 35 U.S.C. § 371 of PCT International Application No. PCT/SE01/00092 which has an International filing date of Jan. 19, 2001, which designated the United States of America.

FIELD OF THE INVENTION

The present invention relates to an air box in a regenerative thermal oxidiser comprising one or several beds of a heat-storing and heat-transferring material, said air box being connected with a gas inlet/outlet and comprising a permeable surface that is turned towards one of said beds.

DESCRIPTION OF THE BACKGROUND ART

Pollutants contained in air or gas may be eliminated by heating the air to such extremely high temperatures that the pollutants are combusted or disintegrate. One economical way of achieving this is to pass the polluted air through a so called regenerative thermal oxidiser (RTO), in which the air is made to flow through a matrix of a heat-storing and heat-transferring medium. The temperature distribution in the medium is such that the air is first heated to the reaction temperature, and thereafter it is cooled again. In this manner, the air is heated only briefly and the heat used to heat the air may be recovered for re-use. In this manner, the plant may be made extremely energy-saving.

To maintain the temperature distribution in the heat-saving and heat-transferring medium the direction of the air flow through the plant is reversed at regular intervals. In this manner, the various parts of the heat-storing and heat-transferring medium will serve alternately as parts giving off heat to and as parts receiving heat from the passing air. They will maintain their mean temperature and the temperature distribution in the medium will remain unchanged.

A common type of a plant of this kind is shown in FIG. 1. The heat-storing and heat-transferring medium is distributed over two different beds 11 and 12 surrounding a common combustion chamber 13. The air enters from underneath and it is heated upon its passage upwards through the bed 11, which is cold at the bottom and warm at the/top. When the air enters the combustion chamber 13 it has reached such a temperature that the combustion and/or disintegration reactions take place in the combustion chamber 13 following nil or only very slight additional heating. Thereafter, the air passes downwards through bed 12, which like bed 11 is warm at the top and cold at the bottom. The heat contained in the air therefore is emitted gradually to the bed material and the air will exit through the outlet 15 via a damper mechanism 14 without carrying any large amounts of thermal energy. At regular intervals, the direction of air flow through the plant is reversed in such a manner that alternately the air will enter through bed 11 and exit through bed 12 and enter through bed 12 and exit through bed 11. Reversal of the air-flow direction is effected with the aid of the damper mechanism 14. Similar types of plants exist wherein the number of beds or regenerators, as they are sometimes called, exceeds two arranged around a common combustion chamber.

Another type of plant is described in U.S. Pat. No. 4,761,690 and is shown in FIG. 2. In this case only one bed 21 of a heat-transferring and heat-storing material is used. The temperature distribution in the bed is such tat the temperatures at the bottom and top of the bed are both low whereas the temperature at the middle of the bed is high. Air to be purified is conveyed by means of a damper mechanism 22 alternately upwards and downwards through the bed. Initially, the air is heated and the combustion and/or decomposition reactions take place in the middle of the bed. The air is then cooled upon its passage outwards through the rest of the bed and can leave the plant without carrying with it large amounts of energy. Owing to the reversal of the air-flow direction through the bed, the upper and lower parts of the bed serve alternately as heating and cooling media, respectively, to heat and cool the air flow in analogy with the two regenerators or beds 11 and 12 of the type of plant shown in FIG. 1. In a corresponding manner, the of the bed of the plant shown in FIG. 2 functions in a manner identical to that of the combustion chamber 13 of the plant shown in FIG. 1.

When entering into and exiting from the plants, the air is distributed over and collected from, respectively, the surface of a bed. This is achieved by using air boxes such as 16 and 17 shown in FIGS. 1 and 23 and 24 shown in FIG. 2, respectively. Both types of plants suffer from the disadvantage that upon reversal of the air-flow direction, the air box handling the entering non-purified air is converted into an air box handling the exiting purified air. This means that the air contained inside this air box at the very moment of reversal is conveyed via the damper mechanism to the plant outlet without having been purified. Upon each reversal of the air-flow direction through the plant a "whiff" of non-purified air thus will be emitted, with consequential reduction of the degree of purification of the plant.

In order to minimise the reduction of the degree of purification it is desirable that the volume of the non-purified air is as small as possible, for which reason the use of air boxes of the smallest possible size is desired. Small air boxes generate high-velocity air flows and consequently high dynamic pressures. Another way of counter-acting reduction of the degree of purification is to collect the whiff at each reversal in a storage unit and to thereafter return this collected amount of air for re-treatment thereof. However, flushing of the non-purified air does not take place as an ideal plug flow. The air velocity furthest away from the air box outlet is low. This means that the volume that needs to be re-circulated for re-treatment considerably exceeds the volume of the air box if one wishes to eliminate the whiff entirely. Therefore, the storage-unit size must be considerable and the re-circulated flow sufficiently large to noticeably affect the flow capacity of the plant. Again, it is desirable to use air boxes of as small volumes as possible.

For efficient plant function, it is important that the flow through the heat-storing and heat-transferring medium is evenly distributed. A particularly important aspect is that equal amounts of air pass in both directions through any one part of the medium. Otherwise, the temperature profile in-between air-flow reversals is not regenerated. At the inlet and the first part of the air box, the air velocity exceeds that at the remote end of the air box. This means that the static pressure is lower in the part of the air box located closest to the outlet than in the part further away. This is true both in the case of flows into the air box as flows out of the air box. This means that the intended vertical air flow through the bed material is overlaid by a horizontal flow. If this flow becomes too large, the function of the plant is jeopardised. The pressure differentials become larger, the higher the air velocities inside the air boxes. Consequently, their volumes are reduced in the direction downwards. This is a particularly damaging feature in large plants. Large horizontal extensions require a considerable vertical height in the air box in order to ensure that the considerable amounts of air that need to be processed per length unit in the transverse direction can be handled.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus arc not limitative of the present invention, and wherein.

Figure 1:
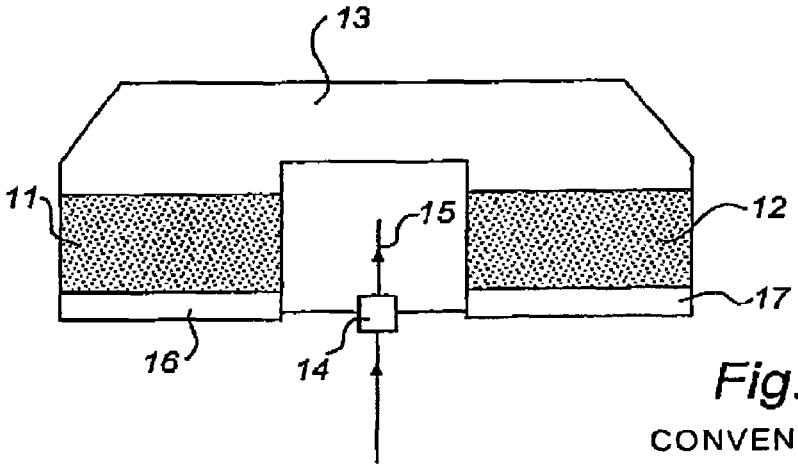
Fig. 1 CONVENTIONAL ART
FIG. 1 shows a conventional plant with heat-storing and heat-transferring medium distributed over two beds.
Figure 2:
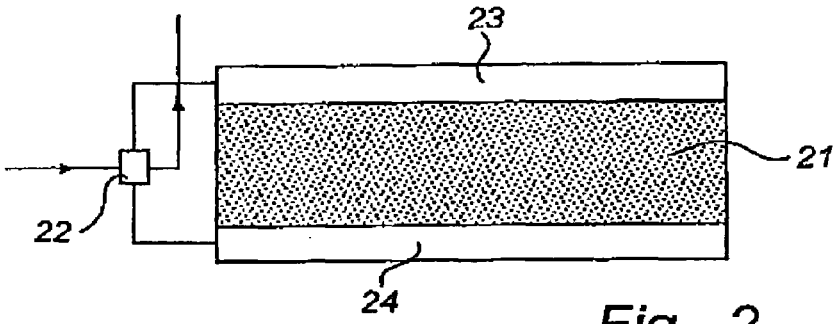
Fig. 2 CONVENTIONAL ART
FIG. 2 shows a conventional plant with one bed having heat-transferring and heat-storing materials.
Figure 3:
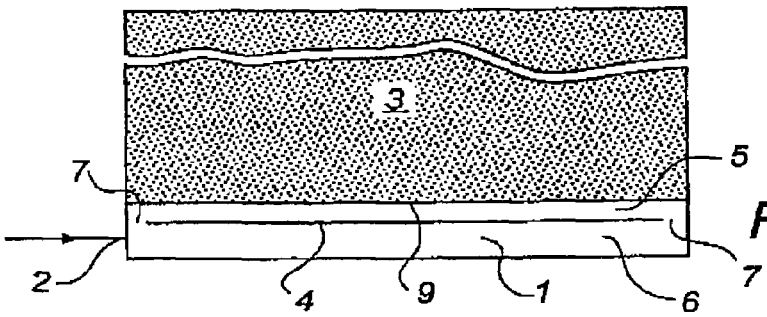
FIG. 3 shows an embodiment of the invention with an air box having a partition.

In accordance with the teachings of the present invention, it becomes possible both to reduce the air-box volumes and to shorten the air-box flushing times. One embodiment of the invention appears item FIG. 3. This drawing figure shows an air box 1 having an inlet/outlet 2. The purpose of the air box is to form a connection to a bed of heat-storing and heat-transferring material 3. A gas permeable surface 9 is provided at the heat-storing and heat-transferring material 3. The novel feature is that the air box 1 contains a partition 4 dividing the air box 1 into two compartments, one compartment 5 adjacent the bed 3 and one compartment 6 which is spaced from the bed. The two compartments communicate via a gap 7 extending along the periphery of the partition. Because the compartment 5 located next to the bed is supplied with air from its entire periphery, the length in the cross-wise direction of the air flow is considerable while at the same time, the distribution/collection length is short. Consequently, it becomes possible to give air box compartment 5 small height dimensions and a small volume without such dimensioning resulting in high air velocities and pressure differentials in this compartment. At the same time, the volume wherein the velocities are really low is small, and consequently satisfactory flushing of polluted air upon reversal of the air flow direction through the plant is obtained in a shorter time than hitherto. Compartment 6 does not border directly on the bed. For this reason higher air velocities are tolerated in this compartment than in a conventional air box. The total volumes of compartments 5 and 6 could be made smaller than the volume in a conventional air box. In air box compartment 6 there is not either any area, in which the air velocity is low and which consequently requires long flushing times.

Figure 4:
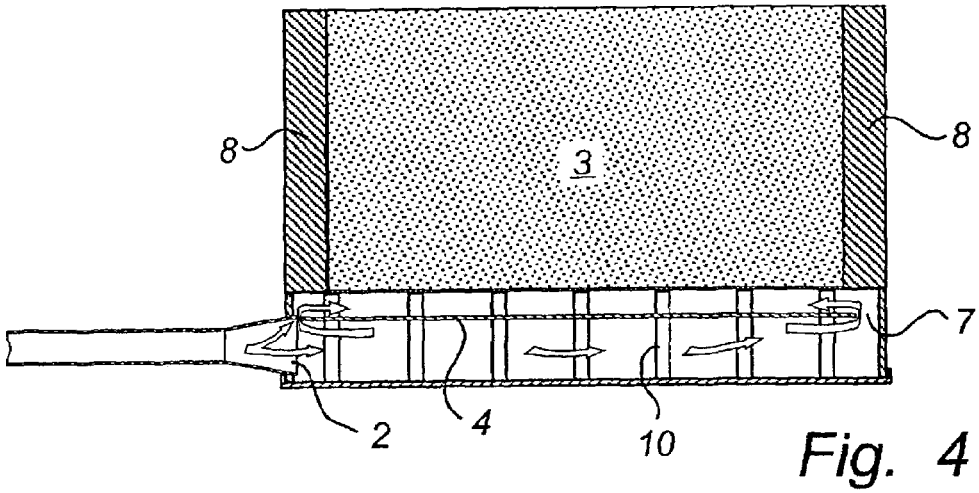
FIG. 4 shows the invention of FIG. 3 in more detail.
Figure 5:
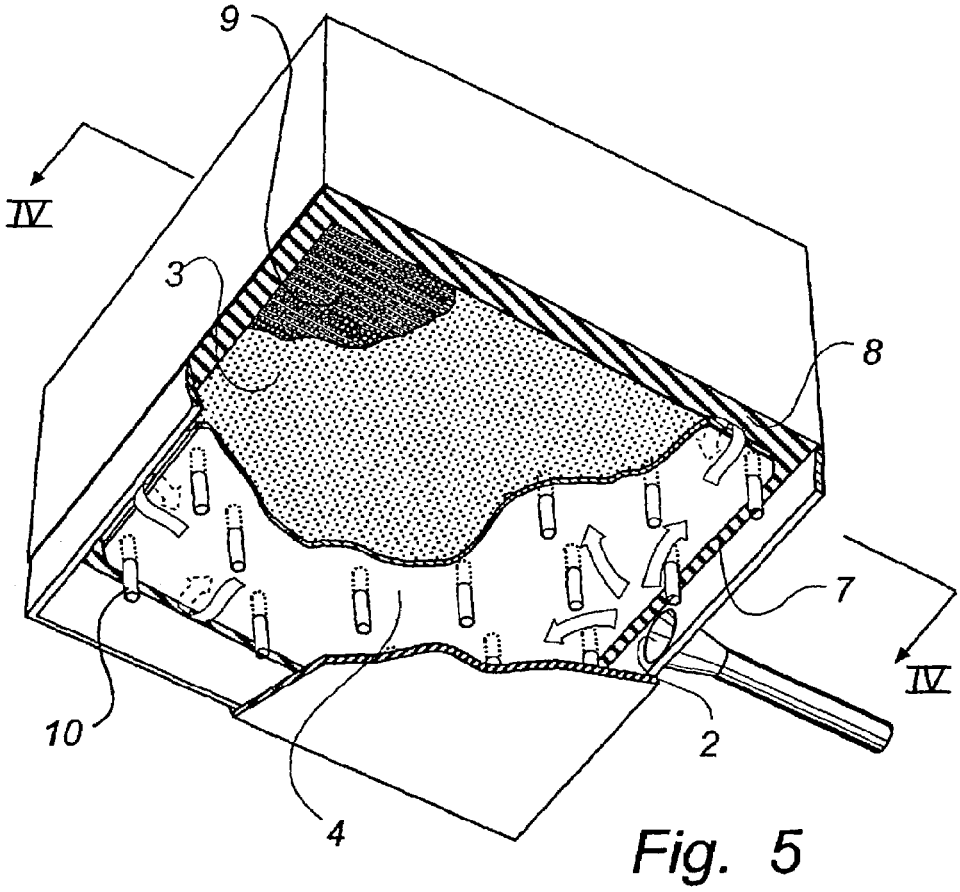
FIG. 5 shows a bottom sectional view of the invention of FIG. 3.

FIGS. 4 and 5 illustrate a similar embodiment in more detail, FIG. 5 showing the air box 1 in a view obliquely from below. The figure also shows an insulating wall 8 surrounding the lateral sides of the bed. Spacer elements 10 are also shown.

An additional advantage offered by the new configuration of the air box is that the high-pressure area generated in the remote end of the conventional air box instead shifts to the center of compartment 5. Disturbances of the air flow occurring there, resulting in thermal losses in the bed, are less serious than disturbances occurring adjacent the outer wall of the bed, where heat losses to the environment already occur. In a plant in accordance with the invention, on the other hand, a low-pressure area is formed along the entire outer wall, resulting in improved thermal economy there, which in turn makes it possible to operate the entire plant in a more energy-saving manner.

When the plant is ready and at its full operational temperature but without air flowing through it, heat is conducted through the bed material in the direction from the top to the bottom. This causes heat losses from the bed. To provide the air box with a partition as shown by the present invention then has the added advantage that the partition acts a radiation screen, which prevents some of this air flow.

The result is reduced heat losses. In addition, the temperature in the outermost parts of the plant is lowered, allowing the use in some cases of less sophisticated and less heat-resistant materials in lids and gaskets and sometimes making contact protection means on the external faces of the plant superfluous. In order to strengthen this effect the partition preferably is made from or coated with a material having a low heat-radiation emission factor and in consequence thereof considerable reflectivity.

To achieve the desired flow distribution through the bed it is possible to vary the width of the gap interconnecting the two compartments 5 and 6 of the air box. Where a larger flow is desired, the gap is made wider, and vice versa. Without negatively affecting the function generally, it is possible to make the gap discontinuous either in order to throttle the flow locally or for structural purposes. Likewise, the gap may be replaced partly or wholly with apertures distributed around the periphery of the partition. Even an embodiment according to which the compartments 5 and 6 of the air box communicate from two directions only offers advantages over an air box without a partition.

The inventive object can function also in case further connections, in addition to those along the periphery, exist between the two air-box compartments or where the partition between the two compartments does not extend across the entire air box. It is likewise possible within the scope of the invention to use several air boxes on either side of the bed. What has been said above with respect to horizontal and vertical directions refers to the shown drawing figures. Obviously, plants could be configured wherein the flow directions differ from those shown without this changing the principle of plant function.

It should be understood that other means than a partition could be used to distribute the air in an advantageous manner in the air box. For example, slotted plates or similar means could be used. In addition, the expression "air" as used in the description and appended claims should be regarded to include other types of polluted gases, in cases where a combustion device including air boxes in accordance with the invention may be used to purify also other gases.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An air box in a regenerative thermal oxidizer having at least one bed of a heat-storing and heat-transferring material having a gas permeable surface, the air box comprising a gas inlet/outlet and pressure distribution means for flow of gas at only a periphery of the pressure distribution means, said pressure distribution means extending across a center of said air box, dividing the air box into a first compartment and a second compartment, at least one through-flow opening being provided in said pressure distribution means, allowing said flow of gas, said through-flow opening being adjacent to an outer wall of said air box, said through-flow opening having a width much smaller than a width of said pressure distribution means, a plurality of spacer elements being provided in the air box between the permeable surface and an opposed face of the air box, the pressure distribution means being attached to the spacer elements wherein the permeable surface is located in the first compartment and the gas inlet/outlet is connected at the second compartment, the at least one through-flow opening being provided by the pressure distribution means between the first and second compartments.

2. The air box as claimed in claim 1, wherein the distribution means extends parallel with the gas permeable surface.

3. The air box as claimed in claim 1, wherein gas flows in and out of the at least one bed through the at least one opening in the distribution means.

4. The air box as claimed in claim 1, wherein the distribution means is a plate.

5. The air box as claimed in claim 4, wherein the at least one flow through opening is provided between the first and second compartments by the distribution means, the at least one flow through opening being a gap between the plate and side walls of the air box.

6. The air box as claimed in claim 5, wherein said gap has a variable width.

7. The air box as claimed in claim 4, wherein a plurality of flow through openings is provided between the first and second compartments by the distribution means, the flow through openings being a series of openings distributed along a periphery of the plate.

8. The air box as claimed in claim 4, wherein the plate being without any direct contact with walls of the air box.

9. The air box as claimed in claim 4, wherein the plate has a surface with heat-radiation reflecting properties.

10. The air box as claimed in claim 4, wherein the plate is flat.

11. The air box as claimed in claim 4, wherein the plate is a solid plate with a periphery, the plate being without any gas flow openings inside the periphery thereof.

12. An air box in a regenerative thermal oxidizer having at least one bed of a heat-storing and heat-transferring material having a gas permeable surface, the air box comprising a gas inlet/outlet and a pressure distribution plate providing for gas flow only at a periphery thereof, said pressure distribution plate extending actoss a center of said air box, dividing the air box into a first compartment and a second compartment, at least one though-flow opening being provided in said pressure distribution plate, a plurality of spacer elements being provided in the air box between the permeable surface and an opposed face of the air box, the plate being attached to the spacer elements, allowing said flow of gas, said though-flow opening being adjacent to an outer wall of said air box, said through-flow opening having a width much smaller than a width of said pressure distribution means wherein the permeable surface is located in the first compartment and the gas inlet/outlet is connected at the second compartment, the at least one through-flow opening being provided by the pressure distribution plate between the first and second compartments.

13. The air box as claimed in claim 12, wherein the at least one flow through opening is provided between the first and second compartments by the plate, the at least one flow through opening being a gap between the plate and side walls of the air box.

14. The air box as claimed in claim 13, wherein said gap has a variable width.

15. The air box as claimed in claim 12, wherein a plurality of flow through openings is provided between the first and second compartments by the plate, the flow through openings being a series of openings distributed along a periphery of the plate.

16. The air box as claimed in claim 12, wherein the plate being without any direct contact with walls of the air box.

17. The air box as claimed in claim 12, wherein the plate has a surface with heat-radiation reflecting properties.

18. The air box as claimed in claim 12, wherein the plate is flat.

19. The air box as claimed in claim 12, wherein the plate is a solid plate with a periphery, the plate being without any gas flow openings inside the periphery thereof.

20. The air box as claimed in claim 12, wherein the plate extends parallel with the gas permeable surface.

21. The air box as claimed in claim 12, wherein gas flows in and out of the at least one bed though at least one opening provided by the plate.

22. An airbox in a regenerative thermal oxidizer, said oxidizer having at least one bed of a heat storing and heat transferring material having a gas permeable surface, the air box comprising;

a housing having a gas inlet/oulet;

a pressure distribution means within said housing dividing the air box into a first compartment and a second compartment which are in communication, said first compartment being adjacent the permeable surface, the second compartment being adjacent the first compartment on a side opposite the permeable surface;

at least one through flow opening being provided in said pressure distribution means allowing gas to flow from said second compartment to said first compartment, said through flow opening being adjacent said housing and having a width much smaller than a width of said pressure distribution means;

a plurality of spacer elements being provided in the air box between the permeable surface and an opposed face of the air box, the pressure distribution means being attached to the spacer elements said gas inlet being connected to said second compartment so that gas flows from the gas inlet into said second compartment, through said through flow opening into said first compartment and through said gas permeable surface into said regenerative themmi oxidizer;

said pressure distribution means preventing gas flow between the second compartment and the first compartment other than through said through flow opening wherein the permeable surface is located in the first compartment and the gas inlet/outlet is connected at the second compartment, the at least one through-flow opening being provided by the pressure distribution means between the first and second compartments.

* * * * *